US006629684B2

(12) United States Patent
Youngren et al.

(10) Patent No.: US 6,629,684 B2
(45) Date of Patent: Oct. 7, 2003

(54) COMBINATION NAIL PULLING TOOL

(75) Inventors: Robert Harold Youngren, Rockford, IL (US); Timothy J. Weir, Sterling, IL (US)

(73) Assignee: Estwing Manufacturing Company, Rockford, IL (US)

( * ) Notice: Subject to any disclaimer, the term of this patent is extended or adjusted under 35 U.S.C. 154(b) by 0 days.

(21) Appl. No.: 09/925,868

(22) Filed: Aug. 9, 2001

(65) Prior Publication Data

US 2003/0030044 A1 Feb. 13, 2003

(51) Int. Cl.[7] ..... B25C 11/00

(52) U.S. Cl. ..... 254/19; 254/26 R; 254/21; 254/18

(58) Field of Search ..... 254/19, 25, 21, 254/18, 27, 23, 30, 26 R

(56) References Cited

U.S. PATENT DOCUMENTS

| | | | | |
|---|---|---|---|---|
| 81,855 A | | 9/1868 | Willard | |
| 149,313 A | | 4/1874 | Hutchins | |
| 187,871 A | | 2/1877 | Langerfeld | |
| 542,989 A | | 7/1895 | Brooks | |
| 30,111 A | | 1/1899 | Thomson | |
| 743,590 A | | 11/1903 | Tarbox | |
| 1,550,894 A | | 8/1925 | Erickson | |
| 1,647,576 A | * | 11/1927 | Nowa et al. | 254/25 |
| 2,087,148 A | | 7/1937 | Hempy | |
| 2,103,008 A | | 12/1937 | Kinest | |
| 2,300,840 A | | 11/1942 | Huxel | |
| 2,325,227 A | * | 7/1943 | Chaddock | 254/25 |
| 3,134,574 A | * | 5/1964 | Reuterfors | 254/25 |
| 3,587,121 A | | 6/1971 | Morrow et al | |
| 3,774,252 A | | 11/1973 | Cantales | |
| 4,844,416 A | | 7/1989 | Hand | |
| 5,054,180 A | | 10/1991 | Combs | |
| 5,695,172 A | * | 12/1997 | Hreha | 254/25 |
| 5,957,429 A | | 9/1999 | Khachatoorian | |

OTHER PUBLICATIONS

4 Pages from website WWW.ESTING.COM regarding various pry bars and pullers, printed on Jan. 18, 2002.

* cited by examiner

*Primary Examiner*—Lee D. Wilson
(74) *Attorney, Agent, or Firm*—Gardner Carton & Douglas LLC

(57) ABSTRACT

In accordance with the principles of the present invention, there is provided a device suitable for pulling nails and other materials from surfaces, most particularly angled surfaces. The device includes a blade end, a shank and a grip end, wherein the blade end further comprises a curved lever, and the grip end is transversely situated opposite the blade end, with the shank interposed between the grip end and the blade end.

10 Claims, 1 Drawing Sheet

COMBINATION NAIL PULLING TOOL

FIELD OF THE INVENTION

The present invention relates generally to nail pulling devices and more specifically it relates to a combination prying and nail pulling device that provides a user with the ability to both pull nails and pry materials from surfaces, particularly angled surfaces.

BACKGROUND OF THE INVENTION

In the field of construction, workers often pry materials from surfaces such as roofing tiles affixed to a roof, or boards affixed to a wall. Using traditional tools, the nails are removed from the materials with a claw hammer or similar device, and a crowbar or other prying tool is used to pry the materials from the surface. The surfaces may be flat or curved, and may further be angled. With respect to angled surfaces such as roofs or slanted walls, prying nails and other materials affixed to the angled surface can be difficult since traditional prying tools tend to be generally straight or with very short hooked pulling heads. Such straight or hooked pulling heads do not provide sufficient leverage against the angled surface, and pulling materials is difficult and slow, requiring repeated pullings to remove materials with a large surface area. In addition, when dealing with such large materials (such as roofing tiles), the short curved surface is generally too short in length to provide an efficient detachment of the materials.

Nail pulling and prying devices are common in the prior art. One common category of such devices are crowbar-type lever devices, which comprise a pulling head that is inserted under the material to be removed and a long shank, where the force is applied at the end of the shank opposite the head. In many crowbar type devices the head is often hooked, resulting in a fulcrum (or pivot point) relatively close to the head. In addition, the hooked head is generally relatively short and sharply hooked, sometimes with an angle between the u-shaped portion of the hook and the shank near or over 90°. This relatively strong curvature combined with the generally short hook limits the distance to which the hook can be inserted under the material to be pried. If the material is long or large, this shape requires the user to make repeated and incremental pullings to remove long or large materials, particularly large sheeted materials such as roofing tiles. Where the head is not hooked but is merely angled, the leverage to be applied is limited by the range of motion the use can make before encountering the surface, i.e., the wall or roof. In these cases, the nail pulling operation is inefficient since the upward motion of the material to be pulled is very limited, and may not exceed the length of the nail. Lastly, many related prior art devices cause damage to the surface from which the materials are pulled. Some of these devices have two pry blades at opposite ends, with the opposing blade extending transversely.

Also included in this category is the common claw-tooth hammer, which has a relatively short shank compared to a crowbar. These devices suffer from the drawback of having a short hook, but also from having a deep curved claw. In such devices, the claw contains the fulcrum, and the curvature of the claw provides the leverage, with greater leverage obtained from more curve being used for rotation. When using such a device to remove nails, for instance, the claw must be inserted such that the nail shank is trapped between the two teeth of the claw. As most nails have a very narrow shank, this means that most of the curvature of the claw used for pulling the nail is wasted, as the nail shank is generally trapped only when inserted deeply into the claw, leaving relatively little curvature left to rotate and provide leverage for extracting the nail.

Thus, using prior art devices having a hooked curve or a very small or no curve, there is insufficient lift area to effectively separate large surface area materials from surfaces. In such cases, many small pulling movements must be taken, rather than one or two large pulling actions that loosen much of the material in one movement. The user will appreciate that small pulling movements are inefficient and can cause undue stress on the body.

It would therefore be an advantage to have an improved nail pulling and prying device that provides greater leverage than prior art devices when removing materials from angled surfaces, or when removing large materials. It would also be an advantage to have a combination device, which combines the functionality of a crowbar with the functionality of a nail puller in a single device that is effective for pulling nails and other materials from angled surfaces.

SUMMARY OF THE INVENTION

A primary object of the invention is to provide an improved combination tool for nail pulling and prying objects with a large surface area in a single device.

Another object of the present invention is to provide an improved device for prying materials and nails from a slanted surface, which device provides more leverage on slanted surfaces than commercially available prior art devices.

A further object is to provide an improved prying device for slanted surfaces wherein the prying portion of the device is configured to enable the prying of material having a large surface area from a slanted surface more easily than compared to conventional prying tools with a hooked blade or blade with little or no curvature.

In accordance with the principles of the present invention, there is provided a device suitable for pulling nails and other materials from surfaces, most particularly angled surfaces. The device includes a blade end, a shank and a grip end, wherein the blade end further comprises a curved lever, and the grip end is transversely situated opposite the blade end, with the shank interposed between the grip end and the blade end.

BRIEF DESCRIPTION OF THE DRAWINGS

Other objects and advantages of the invention will be apparent from the following detailed description and the accompanying drawings, in which.

DETAILED DESCRIPTION OF THE INVENTION

Figure 1:
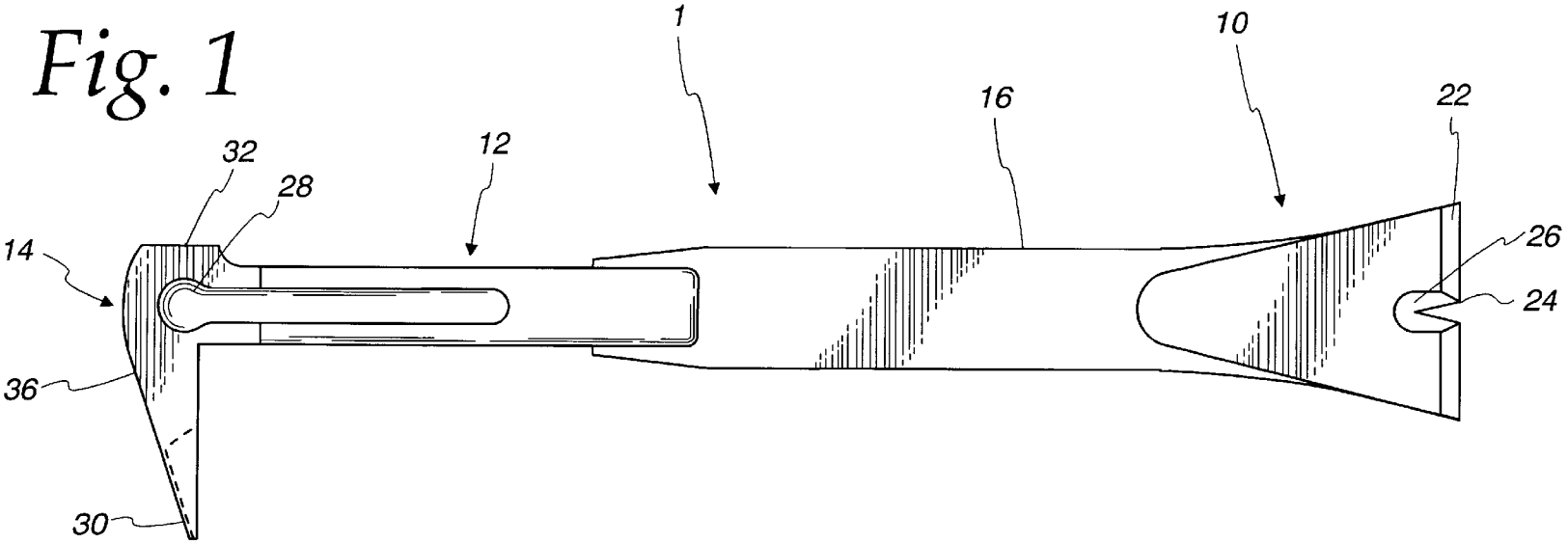
FIG. 1 is a top perspective view of the device of the invention.

While the invention described herein is susceptible to various modifications and alternative forms, certain preferred embodiments are shown by way or example in the drawings and will herein be described in detail. It should be understood, however, that it is not intended to limit the invention to the particular forms described, but to the contrary, the invention is intended to cover all modifications and alternatives falling within the spirit and scope of the invention as defined by the appended claims.

Figure 2:
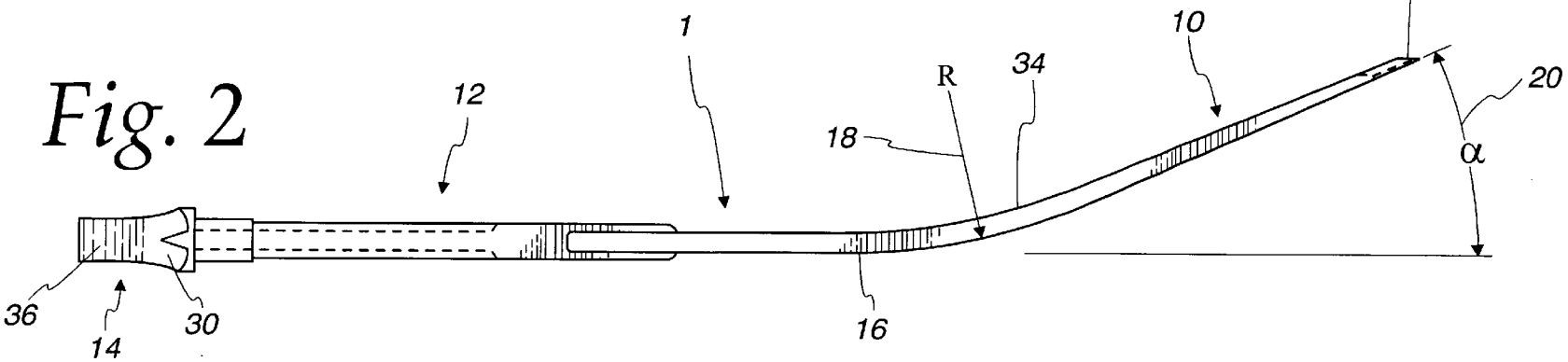
FIG. 2 is a side view of the present invention.

As depicted in FIGS. 1 and 2, the combination nail pulling tool invention includes an elongated blade end 10, opposing grip end 14 and a shank 12 disposed between grip end 14 and blade end 10.

The blade end 10 further comprises a convex lever 16 having an elongated curve 18, which curve 18 extends perpendicularly from the longitudinal plane of the shank 12, the curve 18 and longitudinal plane defining angle of curvature α 20 as shown in FIG. 2. The curve 18 extends about radius of curvature "R", as shown in FIG. 2. Lever 16 merges with a blade 22 which is beveled toward the concave side of the lever 16, to facilitate insertion of the blade into cracks and crevices. Blade 22 may optionally include a generally v-shaped gripping notch 24, as depicted in FIG. 1, which notch may optionally have beveled edges 26 for improved gripping, particularly gripping headed materials such as nails. The configuration of the blade 22 and the notch 24 is particularly useful when a flat material is nailed to a surface, and a simultaneous removal of the material and the nail is desired.

Referring now to FIG. 1, the grip end 14 comprises a gripping head 28, which has a longitudinal plane that extends transversely from the longitudinal plane of blade 22, and may optionally include a claw 30. The viewer will note that the curve 18 defined by angle α 20 is a sloping curve, with angle α 20 generally between 20 and 40 degrees, and most preferably between 25 and 35 degrees. In marked contrast to many prior art prying devices, the gradual, elongated curve 18 is not hooked, but instead permits insertion of the blade 22 and lever 16 below the material to a depth generally near the radius of curvature R, providing a long lift surface (the length of the curve from radius "R" to the blade 20) which is a desired feature for removing large materials such as large roofing tiles, shingles or other roofing materials or large sections of plaster, lath and including 2¼ inch nails.

This angle 20, combined with the transversely extending grip end 14, is an optimal angle for removing materials from slanted surfaces, such as roofs. In addition, the viewer will appreciate that the transversely designed gripping head 28 permits maximum lowering of the tool 1 until the gripping head 28 touches the surface, without interference from claw 30. This feature, combined with the lift realized by curved lever 16, permits the user to achieve maximum lift of the material to be removed from the slanted surface.

In addition to the gradual curve described above, an important feature of the invention resides in the shape of the outer surface of lever 16, which is smooth and generally flat permitting the tool 1 to be rocked on the surface of which material is to be removed from in a direction longitudinally to the blade 22. The grip end 14 is also curved about the end from the striking surface 32 to the end of claw 30, again permitting a rocking movement about the perimeter 36 of claw 28. The lever 16 is flat and the shank 12 is constructed of a single piece of material.

The nail pulling tool 1 is advantageously fabricated from any materials used to fabricate such tools in general, either now known or hereafter developed. Suitable materials include but are not limited to iron, steel, aluminum and various alloys of metals exhibiting sufficient strength and stiffness for the intended purpose.

Thus, it is apparent that there has been provided, in accordance with the present invention, a improved device for nail pulling and prying that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to include all such alternatives, modifications and variations as set forth within the spirit and scope of the appended claims.

What is claimed is:

1. A combination nail pulling tool comprising:

a blade end defining a convex lever having an elongated curve, the blade end having a terminus;

a grip-end; and a shank connecting the blade end to the grip end, the shank defining a longitudinal plane;

wherein the elongated curve and the longitudinal plane define an angle that is from about 20° to about 40°; and wherein a distance from the terminus to the longitudinal plane and perpendicular to the longitudinal plane is at least 2¼ inches.

2. The combination nail pulling tool of claim 1, wherein the elongated curve of the convex lever defines a concave side of the convex lever.

3. The combination nail pulling tool of claim 2, wherein the terminus is beveled toward the concave side of the convex lever.

4. The combination nail pulling tool of claim 3, wherein the beveled terminus includes a V-shaped notch.

5. The combination nail pulling tool of claim 4, wherein the grip end includes a gripping head having a longitudinal plane that is generally perpendicular to the longitudinal plane of the shank.

6. The combination nail pulling tool of claim 5, wherein the gripping head terminates in a claw.

7. The combination nail pulling tool of claim 6, wherein the gripping head is generally flat in the longitudinal plane of the shank.

8. The combination nail pulling tool of claim 7, wherein the gripping head includes a striking surface that is opposite the claw.

9. The combination nail pulling tool of claim 8, wherein the gripping head includes a curved rocker surface that extends from the striking surface to the claw.

10. The combination nail pulling tool of claim 9, wherein the angle is from about 25° to about 35°.

* * * * *